United States Patent [19]

Göbel

[11] 4,230,346

[45] Oct. 28, 1980

[54] ROOF DRAIN

[76] Inventor: Klaus Göbel, Am Forst, 55 Trier-Irsch, Fed. Rep. of Germany

[21] Appl. No.: 830,403

[22] Filed: Sep. 6, 1977

Related U.S. Application Data

[62] Division of Ser. No. 600,189, Jul. 29, 1975, abandoned.

[30] Foreign Application Priority Data

Aug. 1, 1974 [DE] Fed. Rep. of Germany ..... 2437191

[51] Int. Cl.[3] ..... E04D 13/04; F16L 5/02; B29D 27/04

[52] U.S. Cl. ..... 285/42; 138/109; 138/177; 210/474; 264/45.5; 264/46.4; 264/46.9; 264/259

[58] Field of Search ..... 264/45.5, 259, 328, 264/DIG. 83, 46.5, 46.4, 46.9, 54; 210/474; 138/109; 177; DIG. 9; 428/76, 437

[56] References Cited

U.S. PATENT DOCUMENTS

| | | | |
|---|---|---|---|
| 2,347,737 | 5/1944 | Fuller | 264/259 X |
| 2,988,226 | 6/1961 | Campbell | 210/474 |
| 3,007,203 | 11/1961 | Ammons | 138/DIG. 9 |
| 3,036,342 | 5/1962 | Fino | 264/46.4 |
| 3,099,516 | 7/1963 | Henrickson | 264/45.5 |
| 3,182,104 | 5/1965 | Cwik | 264/45.5 X |
| 3,270,114 | 8/1966 | Westlake | 264/259 X |
| 3,388,034 | 6/1968 | McCombie | 428/437 X |
| 3,493,449 | 2/1970 | Krug | 264/46.4 X |
| 3,598,157 | 8/1971 | Farr et al. | 138/177 X |
| 3,608,008 | 9/1971 | Soukup et al. | 264/45.5 |
| 3,703,194 | 11/1972 | Giordano | 138/109 |
| 3,703,571 | 11/1972 | Roberts | 264/46.5 X |
| 3,745,203 | 7/1973 | Harper | 264/DIG. 83 |
| 3,819,779 | 6/1974 | Pharris et al. | 264/45.5 |
| 3,860,537 | 1/1975 | Graham et al. | 264/45.5 X |
| 3,941,157 | 3/1976 | Barnett | 138/177 X |
| 3,986,733 | 10/1976 | Esser | 285/158 |
| 4,028,450 | 6/1977 | Gould | 264/45.5 |

FOREIGN PATENT DOCUMENTS

| | | | |
|---|---|---|---|
| 5705 | 7/1975 | Austria . | |
| 1032571 | 6/1978 | Canada . | |
| 137470 | 8/1978 | Denmark . | |
| 1609148 | 4/1970 | Fed. Rep. of Germany | 210/460 |
| 2125265 | 11/1972 | Fed. Rep. of Germany | 264/DIG. 83 |
| 2163863 | 6/1973 | Fed. Rep. of Germany | 210/474 |
| 2508526 | 12/1978 | Sweden . | |
| 18622 | 10/1976 | Turkey . | |
| 1368600 | 10/1974 | United Kingdom | 428/76 |
| 1491111 | 11/1977 | United Kingdom . | |

OTHER PUBLICATIONS

Pilaro, Joseph F., "Ethylene-Vinyl Acetate", in *Machine Design,* Plastics Reference Issue, vol. 38, No. 14, Jun. 16, 1966, p. 59.

Dubois, J. Harry and Frederick, W. John, "Plastics", New York, Reinhold, c 1967, p. 52.

Modern Plastics Encyclopedia, 1973-1974, vol. 50, No. 10A, Oct. 1973, pp. 550, 551, 554, 686, 687.

Alwitra Flat Roof Products, Nos. 1-11, Klaus Gobel, Trier, W. Germany, Alwitra KG.

Dickert, E. A.; W. A. Himmler; D. E. Hipchen; M. Kaplan; H. A. Silverwood and R. Zettler, "Molding of One-Shot Rigid Urethane Foam", in *Chemical Engineering Progress,* (vol. 59, No. 9), Sep. 1963, pp. 33-38.

Lanigan, W. J., "Microwave Curing of Flexible Polyurethane Foam Mouldings", in *British Plastics,* Oct. 1963, pp. 562-565.

Mobay Bulletin, "The Rolling Showcase for Engineering Plastics", Pittsburgh, Pa., Mobay Chemical Co., n 1968, p. 8.

Metzger, S. H. and D. J. Prepelka, "Progress in RIM Technology", in *J. of Elastomers and Plastics,* vol. 8, (Apr. 1976), pp. 141-159.

*Primary Examiner*—Philip Anderson

*Attorney, Agent, or Firm*—Robert W. Beach; Ward Brown

[57] ABSTRACT

A roof drain, for receiving rain water from a roof and conducting it to a drain pipe, includes a drain body made from polyurethane foam and having a flange integral with and adjacent to the inlet end of such drain body. A collar which makes sealing connection with the roof covering is attached to the drain body flange by molding the drain body in contact with a preformed collar of vinyl acetate ethylene material.

4 Claims, 2 Drawing Figures

ROOF DRAIN

This is a division of application Ser. No. 600,189, filed July 29, 1975, now abandoned.

This invention relates to a roof drain for receiving water from a roof, particularly a flat roof, and leading such water to a drain pipe. The drain includes a drain body which is molded from polyurethane foam. The drain also includes, at its upper end, a collar for sealing with the roof covering and a seat for a grating or gravel trap.

In known roof drains there is difficulty in sealingly connecting the drain to the roof covering.

To overcome this difficulty it is known to provide a connection collar which is bonded or welded to the roof covering adjacent to the drain opening, the connection collar being connected to the drain body by special fastening means. Such construction entails production difficulties.

It is also known to connect a collar in the form of a plastic sheet into a flange at the top of the drain body. Since, however, the drain body and the collar sheet have different coefficients of expansion changes in temperature, as occur on a roof, frequently lead to displacement or misalignment of the edge of the sheet and also cracking of the drain body so that additional clamping or screw connections are usually used in order to connect the drain body and the sheet securely to each other.

An object of the invention is to provide an improved roof drain.

The invention provides a roof drain for receiving water from a roof and conducting it to a drain pipe. The drain includes a drain body which is formed of polyurethane foam and has an upper flange. A flat sheet connection collar for sealing with roofing material is attached to such flange by molding the drain body in contact with the margin of an aperture the collar.

Advantageously retaining means for the grating or gravel trap is in the form of latching elements projecting into the drain aperture below the plane of the collar. These latching elements can be carried on a retaining ring and the ring can be attached to the drain inner periphery during molding of the drain body.

The invention also provides a method of producing a roof drain wherein the drain body is produced from polyurethane foam in a mold heated to a temperature between 120° C. and 160° C., preferably 140° C., and at a pressure of between 4 and 6 atm, preferably 4.5 atm. The margin of the connection collar aperture is joined to the body during production of such body.

Figure 1:
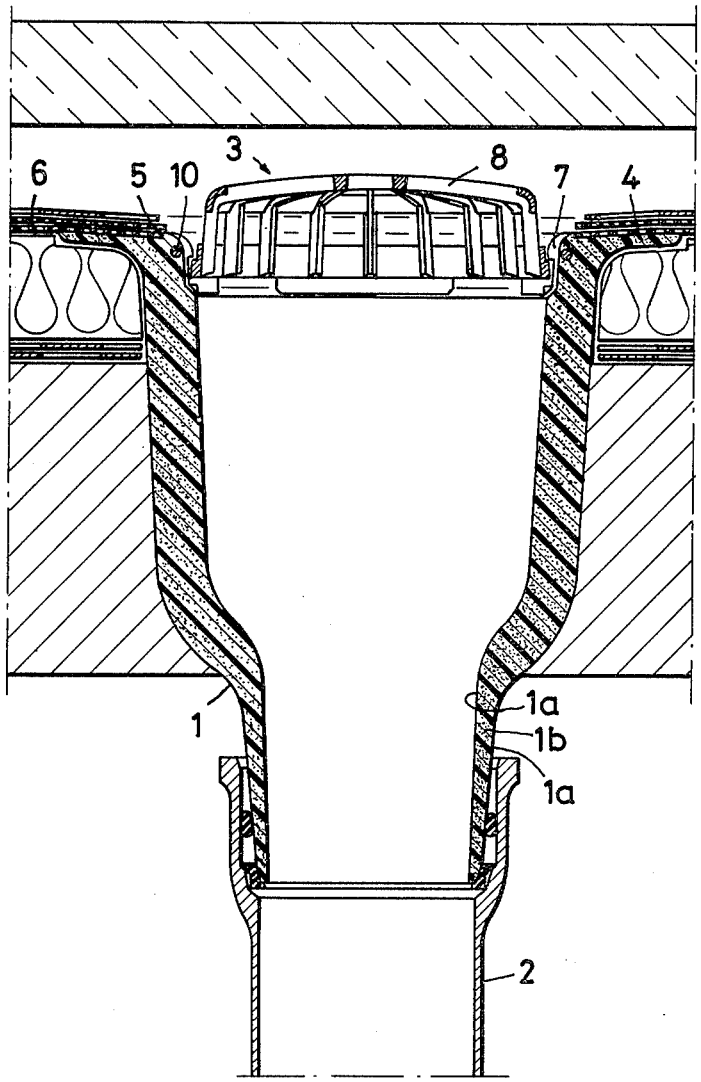
Figure 2:
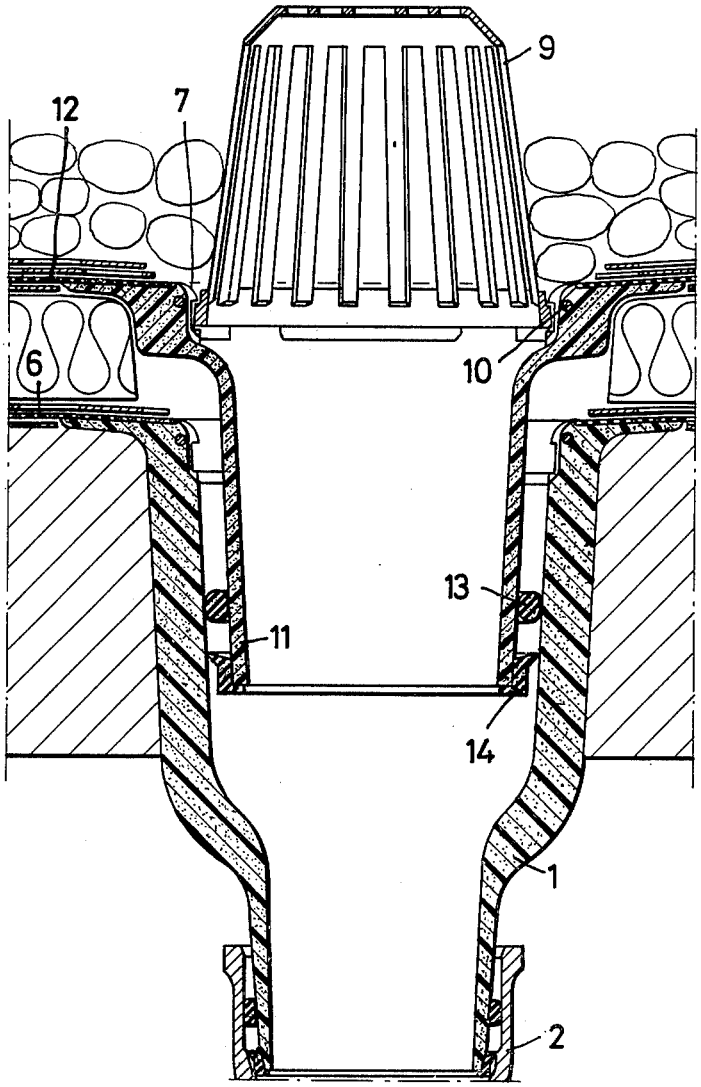

The invention will be described further, by way of example, with reference to the accompanying drawings, in which:

FIG. 1 is a vertical section through a preferred embodiment of roof drain of the invention in position on a roof; and FIG. 2 is a vertical section through a roof having two roof drains of the invention, the collar of one drain being connected to the roofing sheet above an insulating layer and the other drain collar being connected to a roofing sheet below such insulating layer. Such roof construction is used when a roof is subject to high temperatures.

A first preferred embodiment of the roof drain of this invention has a hollow body including a tube portion 1 which leads water collected by the drain to a drain pipe

2 below it. The drain body is made from polyurethane foam and has integral hard steamtight outer layers 1*a* or skin and a heat-insulating core 1*b* which are molded in one operation. The body also has an outwardly projecting annular flange 4 encircling its inlet aperture 3, which flange has a marginal recess 5 in its upper surface. Edge portions of a connection collar 6, surrounding the inlet aperture 3, are received in the recess 5. The collar 6 is a sheet of elastic vinyl acetate ethylene polymer material having a control aperture. During production of the drain body, the collar 6 is placed in a mold and the polyurethane foam drain body is molded in contact with the margin of the collar aperture to seal the collar to the drain body flange.

A peripheral seat for a grating 8 or gravel trap 9, is formed adjacent to the mouth of the inlet aperture 3 and includes inwardly-projecting retaining elements or dogs 7 which serve to retain the grating 8 or gravel trap 9. The grating 8 or gravel trap 9 can be inserted and is retained in the drain mouth by the dogs 7, forming a bayonet latch. The elements 7 preferably are carried by a preformed retaining ring which is placed in the mold and attached to the drain body during foaming of such body.

As shown in FIG. 2, when a roof has an insulating layer between a lower layer of roofing material and an upper layer of roofing material two drains of the invention can be used. The connection collar 6 of the first drain is sealed to the lower roofing layer. A second drain 11 is nested in the first drain with its connection collar 12 disposed in sealing relationship with the roofing surface layers above the insulating layer. The inner end of drain 11 is sealed relative to the lower drain by a ring 13 and a lip seal 14. Such seals prevent access of moisture to the space between the two drains and their collars 12 and 6.

The molding of the polyurethane drain body foam takes place at a temperature between 120° C. and 160° C., preferably about 14° C. and at a pressure from 4 to 6 atm, preferably 4.5 atm. The bond between the polyurethane foam in the flange and the vinyl acetate ethylene sheet material is very strong and durable. Furthermore thermal expansion has little effect on the strength and water-sealing properties of the bonded joint.

I claim:

1. In a roof drain for installation in a roof subjected to varying ambient atmospheric temperatures for receiving water from the roof including a connection collar bondable to adjacent roofing material of the roof and having an aperture therein and a tubular drain body disposed with its drain channel substantially in alignment with the connection collar aperture and having on one end thereof an external flange adjacent to such connection collar aperture, the improvement comprising the drain body flange being joined by a contiguous integral liquidtight bonded joint to the margin of the connection collar aperture, said joint being leakproof over the range of ambient atmospheric temperatures to which the roof is subjected by such drain body flange being molded in contact with the connection collar aperture margin and because the drain body flange material and the collar aperture margin material, while different, have approximately equal coefficients of thermal expansion, which prevents appreciable differential expansion of the drain body flange and the connection collar aperture margin tending to rupture said joint therebetween.

2. The roof drain defined in claim 1, in which the connection collar is ethylene vinyl acetate copolymer material, and the drain body is polyurethane foam material.

3. In a roof drain for installation in a roof subjected to varying ambient atmospheric temperatures for receiving water from the roof including a connection collar bondable to adjacent roofing material of the roof and having an aperture therein and a tubular drain body disposed with its drain channel substantially in alignment with the connection collar aperture and having on one end thereof an external flange adjacent to such connection collar aperture, the improvement comprising the drain body flange being joined by a contiguous integral liquidtight bonded joint to the margin of the connection collar aperture, the connection collar material and the drain body material having different physical and chemical characteristics but having thermal coefficients of expansion sufficiently similar as to maintain a leakproof bond between the drain body flange and the connection collar aperture margin at all ambient atmospheric temperatures to which the roof is subjected by preventing appreciable differential expansion of the drain body flange and the connection collar aperture margin tending to rupture said joint therebetween.

4. The roof drain defined in claim 3, in which the connection collar is ethylene vinyl acetate copolymer material, and the drain body is polyurethane foam material.

* * * * *

UNITED STATES PATENT AND TRADEMARK OFFICE

CERTIFICATE OF CORRECTION

PATENT NO. : 4,230,346

DATED : October 28, 1980

INVENTOR(S) : Klaus Göbel

It is certified that error appears in the above-identified patent and that said Letters Patent are hereby corrected as shown below:

Title Page, left column, section [56], References Cited, U.S. PATENT DOCUMENTS, following the line
"3,608,008 9/1971 Soukup et al.....264/45.5"
insert:
--3,657,036 4/1972 Mullenhoff et al...156/79--.

Title Page, right column, line 4, cancel "2508526" and insert --7508526--; under heading OTHER PUBLICATIONS, line 8, cancel "Gobel" and insert --Göbel--; line 18, cancel "n" at the end of the line.

Column 1, line 24, insert a comma after "expansion"; line 39, after "aperture" insert --through--; line 68 (last line) cancel "drain pipe" and insert --drainpipe--.

Column 2, line 15, cancel the comma; line 27, insert a comma after "material"; line 37, before "drain" insert --foam--; same line, cancel "foam" at the end of the line; line 39, cancel "14°" and insert --140°--; same line, insert a comma after "C."; line 43, insert a comma after "more".

Signed and Sealed this

Twenty-fourth Day of March 1981

[SEAL]

Attest:

RENE D. TEGTMEYER

Attesting Officer

Acting Commissioner of Patents and Trademarks